US010946355B2

(12) United States Patent
Kastl et al.

(10) Patent No.: US 10,946,355 B2
(45) Date of Patent: Mar. 16, 2021

(54) DEVICE AND METHOD FOR DISPERSING AT LEAST ONE SUBSTANCE IN A FLUID

(71) Applicant: NETZSCH-Feinmahltechnik GmbH, Selb (DE)

(72) Inventors: Dominik Kastl, Fichtelberg (DE); Markus Nichterlein, Himmelkron (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 249 days.

(21) Appl. No.: 15/751,816

(22) PCT Filed: Jul. 23, 2016

(86) PCT No.: PCT/DE2016/000287

§ 371 (c)(1),
(2) Date: Feb. 9, 2018

(87) PCT Pub. No.: WO2017/025073

PCT Pub. Date: Feb. 16, 2017

(65) Prior Publication Data

US 2018/0236423 A1 Aug. 23, 2018

(30) Foreign Application Priority Data

Aug. 13, 2015 (DE) ..... 10 2015 113 380
Feb. 17, 2016 (DE) ..... 10 2016 102 728

(51) Int. Cl.

| | |
|---|---|
| ***B01F 15/00*** | (2006.01) |
| ***B01F 15/02*** | (2006.01) |
| ***B01F 3/12*** | (2006.01) |
| ***B01F 5/16*** | (2006.01) |
| ***B01F 3/08*** | (2006.01) |
| *B01F 5/00* | (2006.01) |

(52) U.S. Cl.

CPC ..... *B01F 15/0265* (2013.01); *B01F 3/0807* (2013.01); *B01F 3/0811* (2013.01); *B01F 3/1221* (2013.01); *B01F 5/16* (2013.01); *B01F 5/165* (2013.01); *B01F 2003/125* (2013.01); *B01F 2005/004* (2013.01); *B01F 2005/0005* (2013.01); *B01F 2005/0008* (2013.01)

(58) Field of Classification Search

CPC .. B01F 3/0807; B01F 15/0265; B01F 3/0811; B01F 3/1221; B01F 5/16; B01F 5/165; B01F 2003/125; B01F 2005/0005; B01F 2005/0008; B01F 2005/004

See application file for complete search history.

(56) References Cited

U.S. PATENT DOCUMENTS

2006/0268657 A1* 11/2006 Schertenleib ..... B01F 3/1221 366/171.1

FOREIGN PATENT DOCUMENTS

| | | |
|---|---|---|
| DE | 2004143 A1 | 8/1971 |
| DE | 3002429 C2 | 1/1989 |

(Continued)

*Primary Examiner* — Anshu Bhatia
(74) *Attorney, Agent, or Firm* — Whitmyer IP Group LLC

(57) ABSTRACT

A device and a method for dispersing at least one substance in a fluid is disclosed. The device includes a process housing with a rotor, a fluid supply, a feed line for the at least one substance to be dispersed having at least one outlet opening, as well as a product outlet. The rotor brings about an axial delivery of a supplied fluid at least in some sections. Furthermore, the rotor brings about a radial delivery of the supplied fluid at least in some sections.

20 Claims, 7 Drawing Sheets

(56) References Cited

FOREIGN PATENT DOCUMENTS

| | | | |
|---|---|---|---|
| DE | 4118870 | A1 | 12/1992 |
| EP | 2676725 | A1 | 12/2013 |

* cited by examiner

DEVICE AND METHOD FOR DISPERSING AT LEAST ONE SUBSTANCE IN A FLUID

TECHNICAL FIELD

The invention relates to a device for dispersing a substance in a fluid, in particular in a suitable liquid.

BACKGROUND

Dispersion is understood to mean the mixing of at least two substances which do not or scarcely dissolve into one another or chemically combine with one another. During dispersion, a substance (disperse phase) is distributed in another substance (continuous phase), wherein an emulsion or a suspension arises. In the case of an emulsion the disperse phase is also liquid, whereas in the case of a suspension solid particles are present finely distributed in a liquid.

Many devices for dispersion are based on the so-called rotor-stator principle. A rotor is thereby moved with a high peripheral speed. This rotation brings about a suction effect, which sucks the medium into the rotor and presses it outwards through the openings, teeth or suchlike of the stator, wherein the disperse phase disperses in the continuous phase.

DE 4118870 A1 describes a device for the wetting and dispersing of powders in liquids. The introduction of the powder substances takes place at low concentrations in a single pass. In the case of high concentrations, the operation takes place by circulation until the final concentration is reached. This device uses a conventional rotor-stator system, which is subject to a high degree of wear. In addition, a flow resistance, which limits the pumping effect of the device, is generated by the installed stator.

DE 3002429 C2 discloses a device for mixing at least one substance with a liquid. The substances to be mixed in are introduced via lateral connecting pipes into a pipe surrounding the rotor shaft. The liquid enters at the open upper end of the stator in an annular space provided between the stator and the pipe surrounding the rotor shaft, passes to the blades of the rotor and then exits again at the lower open end of the stator. The substances to be dispersed are fed in by being introduced via the connecting pipes below the level of the liquid. It is thus possible to mix the substances to be mixed in below the level of the liquid, in such a way that said substances have no contact with the atmosphere surrounding them before the mixing. According to the description, grinding bodies can also be used in the first process region in this machine. However, this leads to a flow resistance which adversely affects the pumping effect. The use of grinding bodies inside the machine also leads to increased wear, in particular on the separating device.

DE2676725 describes a device for mixing, and in particular for dispersing. The latter comprises a housing, a separating device and a rotor unit. The separating device divides the housing into a first process region and a second process region. A first section of the rotor unit is arranged in the first process region and a second section of the rotor unit is arranged in the second process region. The supply of the substances to be mixed to the first process region takes place spaced apart from the rotor unit. The risk of contamination of the powder supply by liquid or liquid-powder mixture thus arises.

DE2004143 discloses a device for the production of emulsions and suspensions in the form of a centrifugal homogenising machine. It employs a rotor-stator system in a multi-row arrangement. A multi-row structure usually means increased outlay on maintenance. In addition, more parts may be subject to wear which accordingly have to be replaced, which leads to increased costs. The powder suck-in pipe and the pipe supplying the liquid end in each case at the end face of the rotor, wherein the gap between the mouth of the feed pipes and the rotor can be adjusted and thus changed.

The problem of the invention is to provide an improved device for dispersing at least one substance in a fluid, in particular a device for dispersing at least one powdery substance in a liquid. The device should preferably be constituted in a more compact and space-saving manner than devices known from the prior art; furthermore, the device should be designed in a technically straightforward manner and thus capable of being produced cost-effectively and should have low maintenance requirements.

SUMMARY

The above problem is solved by a device and a method for dispersing a substance in a fluid, according to the invention.

The invention relates to a device for dispersing at least one substance in a fluid. Such a device comprises a process housing with a rotor, a fluid supply, a feed line for the at least one substance to be dispersed and having at least one outlet opening, as well as a product outlet. The rotor is operated for example by means of an electromotive drive, which is arranged outside the process housing. In particular, the rotor is arranged on a drive shaft, which is passed through one of the housing walls of the process housing and sealed for example with a slip-ring seal and is mounted rotatably by means of a bearing.

The rotor is constituted such that at least in some sections an axial delivery of a supplied fluid can be generated by the rotor. Furthermore, at least in some sections a radial delivery of the supplied fluid can be generated by the rotor.

The rotor preferably comprises at least one first means for generating the axial delivery of the supplied fluid at least in some sections and at least one second means for generating the radial delivery of the supplied fluid at least in some sections.

According to an embodiment of the invention, provision is made such that the regions of the axial delivery and of the radial delivery do not overlap, i.e. a first region is provided in which an axial delivery takes place predominantly or completely and a second region is provided in which a radial delivery takes place predominantly or completely. If appropriate, an intermediate region can be present, in that both an axial and also a radial delivery take place. Embodiments are thus also conceivable wherein the regions of the axial and the radial delivery overlap at least in some sections.

According to embodiment of the invention, an axial delivery of the supplied fluid predominantly takes place in a first region. Furthermore, a slight radial delivery also already takes place in this first region, which transforms in the direction of the product outlet of the device into a completely radial delivery of the fluid.

In order to prevent fluid from getting into or onto the at least one outlet opening, provision is made according to a preferred embodiment such that the feed line for the substance to be dispersed is surrounded at least in some sections by the rotor. In particular, the at least one outlet opening of the feed line is assigned to a region of the rotor in which the fluid is delivered predominantly axially.

To achieve this, the rotor preferably comprises guide structures which generate the axial delivery effect of the rotor. The guide structures are constituted in particular such that on the one hand they represent the at least one first means for generating the axial delivery at least in some sections and on the other hand they form the at least one second means for generating the radial delivery at least in some sections.

Furthermore, the rotor has a widening cross-section, in particular the cross-section of the rotor widens on the drive side, i.e. in the direction of the rotor side facing away from the feed line for the substance to be dispersed. As a result of this widening of the rotor cross-section in the direction of the product outlet, in particular in combination with the guide structures of the rotor, the axial delivery of the fluid in the region of the at least one outlet opening with the increasing rotor cross-section transforms into a radial delivery effect. Furthermore, the effect of the rotation of the rotor generated by the drive is that the fluid enters into a rotational motion.

The guide structures are preferably constituted on the side of the rotor facing the feed line for the substance to be dispersed. The rotor comprises a solid rotor core, the cross-section whereof—as already described—widens at least in some sections in the direction of the product outlet. At least one of the guide structures is preferably extended beyond a solid core of the rotor in the axial direction in the direction of the feed line for the substance to be dispersed. A plurality of guide structures are preferably extended beyond a solid core of the rotor in the axial direction in the direction of the feed line for the substance to be dispersed. According to an embodiment, provision is made such that the at least one outlet opening of the feed line for the substance to be dispersed is surrounded at least in some sections by the at least one extended guide structure, so that the substance to be dispersed is released from the feed line inside guide structures of the rotor.

According to embodiment, provision is made such that the number of the extended guide structures is variable in relation to the number of the total guide structures. For example, a rotor can have such a high density of guide structures that it suffices for the functioning of the guide structures if only every second guide structure has an extension beyond the rotor core.

The feed line for the substance of the dispersed is arranged in particular in such a way that the at least one outlet opening for the substance to be dispersed is surrounded at least in some sections by the extended guide structures outside the solid rotor core. As a result of the centrifugal forces, which occur when the rotor rotates and which act on the fluid and/or the substance exiting via the at least one outlet opening, the fluid is effectively kept away from the at least one outlet opening of the feed line for the substance to be dispersed, so that sticking of the substance to be dispersed in or on the at least one outlet opening of the feed line of the substance to be dispersed can be effectively prevented.

According to a further embodiment, the rotor can comprise a plurality of guide structures which are formed in the region of the rotor surface. It is conceivable to extend only one guide structure beyond the rotor core and to constitute the extension such that the latter at least partially or for the most part completely surrounds the outlet opening for the substance to be dispersed. For example, the extension of the one guide structure could be run helically about the longitudinal axis of the feed line for the substance to be dispersed.

The guide structures, in the region of their extension beyond the solid rotor core in the central region of the rotor, i.e. in the region of the rotational axis of the rotor, are constituted as an accommodation for the feed line for the substance to be dispersed. In particular, the guide structures comprise in the region of their extension a central recess, which is constituted corresponding to the feed line for the substance to be dispersed.

According to a preferred embodiment, the guide structures in the region of their extension beyond the solid of rotor core are constituted coaxial with the rotational axis of the rotor. In particular, the extension of the guide structures forms the first means for generating the axial delivery at least in some sections. Furthermore, the guide structures are curved in the region of the solid rotor core. The curved partial region of the guide structures forms in particular the second means for generating the radial delivery at least in some sections. A high outlet pressure and a good delivery effect are achieved by the curvature of the guide structures. In particular, the curved guide structures assist the radial delivery during the rotation of the rotor.

The effect of the extended guide structures is that, already in the region of the at least one outlet opening, although the latter is arranged outside the solid rotor core, an axial delivery of the fluid towards the solid rotor core or in the direction of the product outlet is achieved. Centrifugal forces also act as result of the rotation of the rotor, which prevent fluid from getting inside. In particular, the centrifugal forces prevent fluid from being able to penetrate into the accommodation region between the extended guide structures, in which region the at least one outlet opening is arranged.

According to an embodiment of the invention, provision is made such that the feed line for the substance to be dispersed has a first longitudinal axis. In particular, the feed line for the substance to be dispersed is constituted as a pipe with a first longitudinal axis. The rotor is mounted rotatably about a rotational axis, for example the rotational axis is formed by the drive shaft. The longitudinal axis of the feed line for the substance to be dispersed and the rotational axis of the rotor can preferably be aligned coaxial or parallel with one another according to an embodiment. According to an embodiment, the outlet opening of the feed line for the substance to be dispersed can be arranged aligned with the longitudinal axis of the feed line for the substance to be dispersed and the rotational axis of the rotor.

According to a further embodiment, provision is made such that the feed line for the substance to be dispersed is arranged at an angle to the rotational axis of the rotor. In this embodiment, the feed line for the substance to be dispersed also ends in the centre of the rotor. In particular, the feed line for the substance to be dispersed constituted at an angle to the rotational axis of the rotor is also arranged in this embodiment such that the at least one outlet opening of the feed line for the substance to be dispersed is surrounded at least in some sections by the extended guide structures outside the solid rotor core. This prevents fluid from entering into the feed line for the substance to be dispersed. Instead, the fluid is diverted outwards directly via the guide structures of the rotor by the centrifugal forces occurring due to the rotation of the rotor.

Due to the angular entry of the feed line for the substance to be dispersed into the rotor, the recess formed by the extended guide structures must be opened. The effect of this is that in the lower region a greater spacing between the outlet opening of the feed line for the substance to be dispersed and the rotor results, whereas in the upper region the desired small spacing between the outlet opening of the feed line and the extended guide structures of the rotor results. The lower enlarged spacing is however not problematic, since the fluid does not have a tendency to flow from below into the feed line.

An essential advantage of this further embodiment with an angular arrangement of the feed line consists in the fact that the fluid, especially in the state when the device is switched off, cannot flow into the feed line for the substance to be dispersed. It is thus reliably ensured even in the rest state of the device that no fluid can get into the feed line and therefore no substance to be dispersed can stick inside the feed line. Furthermore, provision can be made such that the fluid supply is arranged largely orthogonal to the feed line for the substance to be dispersed. For example, the fluid supply can have a second longitudinal axis. In particular, the fluid supply is constituted as a pipe with a second longitudinal axis. The fluid supply is arranged spaced apart from the rotor in the process housing, in particular on the side of the feed line for the substance to be dispersed, so that introduced fluid flows at least in some sections around the feed line for the substance to be dispersed.

According to a further embodiment, provision is made to arrange the fluid supply for the most part obliquely with respect to the feed line for the substance to be dispersed, in particular at an angle between 0 degrees and 90 degrees.

The fluid is conveyed outwards from the middle of the rotor by the guide structures of the rotor and as a result of the centrifugal forces occurring during the rotation of the rotor, so that the fluid cannot get into the central region in which the at least one outlet opening of the feed line for the substance to be dispersed is arranged. In particular, the fluid does not therefore enter into the region of the rotational axis of the rotor.

According to an embodiment of the invention, provision is made such that the feed line for the substance to be dispersed can be adjusted axially, in particular the feed line for the substance to be dispersed can be displaced relative to the process housing along its longitudinal axis axially and/or parallel to the rotational axis of the rotor. The depth to which an end region of the feed line for the substance to be dispersed is inserted into the extended guide structures of the rotor and therefore the spacing between the end region of the feed line for the substance to be dispersed that has the at least one outlet opening and the solid core of the rotor can thus be changed depending on the supplied substance.

A radial spacing is preferably constituted between the extended guide structures of the rotor and the feed line for the substance to be dispersed. The spacing is necessary in order that the substance can exit from the at least one outlet opening and pass through between the guide structures into the fluid. A spacing of approximately 0.1 mm to approximately 10 mm in the radial direction is preferably present between the extended guide structures of the rotor and the feed line for the substance to be dispersed. Furthermore, provision is made such that a gap is constituted in the axial direction between the feed line for the substance to be dispersed and the rotor, through which gap the substance passes radially into the fluid.

According to an embodiment of the invention, the rotor comprises a plurality of guide structures, wherein only some of the guide structures have axial extensions constituted as a first means for generating the axial delivery at least in some sections. For example, the rotor comprises an even number of guide structures, wherein only every second guide structure is extended axially beyond the solid rotor core. This may be advisable especially in the case of a high density of guide structures on the rotor core. In particular, this prevents the extensions from forming a ring around the rotational axis which is so dense that a transfer of the substance from the feed line into the fluid could be prevented.

The feed line for the substance to be dispersed can have an increased diameter in the region of the at least one outlet opening, for example in the form of an offset, which serves as an additional deflecting element. It is thus also ensured that no fluid can get into and/or onto the least one outlet opening of the feed line.

The at least one outlet opening does not have to be constituted as an open end of the feed line for the substance to be dispersed. According to an embodiment of the invention, the feed line for the substance to be dispersed is formed by a pipe, the end of which arranged in the direction of the solid rotor core between the guide structures is closed and which comprises in this end region a plurality of lateral openings as outlet openings for the substance in the radial direction.

The substance is also conveyed outwards by the centrifugal forces, i.e. in the direction of the outer edge of the rotor. The substance is thereby dispersed in the fluid. This takes place especially in the outer edge region of the rotor in an intermediate space between the rotating rotor and the static process housing.

According to a further embodiment, provision can be made such that the inner diameter of the feed line for the substance to be dispersed is variable and can thus be adapted to the requirements made on the feed line for the substance to be dispersed. In particular, the delivery quantity and the flow rate can be adjusted. Provision can for example be made such that formatting parts reducing the cross-section can be inserted into the feed line for the substance to be dispersed, in order to vary the diameter and therefore the cross-sectional area of the feed line for the substance to be dispersed. The variable adjustment takes place for example by using additional internal pipes with smaller diameters for the powder supply pipe. The internal pipes can be made for example of PTFE or another suitable plastics material. Alternatively, an exchange of the rotor and the supply pipe is made, wherein for example a plurality of different sizes of rotor and powder supply pipe can be provided for selection as formatting parts.

According to an embodiment of the invention, the first longitudinal axis of the feed line for the substance to be dispersed is orientated horizontal and the second longitudinal axis of the fluid supply is arranged vertical. In particular, provision can be made such that the fluid supply takes place from above.

The fluid enters via the fluid supply into the process housing and is taken up by the rotor, which accelerates the fluid in the axial and radial direction. A pumping effect thus takes place, which pumps the fluid through the product outlet into a container. An underpressure arises in the process housing as a result of the high pumping effect. As soon as the feed line for the substance to be dispersed is opened, a suction effect is created in the process housing as a result of the underpressure. The substance is thus sucked through the feed line for the substance to be dispersed. The substance exits via the at least one outlet opening arranged between the extended guide structures and passes radially into the fluid. The dispersion or suspension thus arising is discharged by the rotor from the process housing via the product outlet. As a result of the narrow gap between the guide structures and the feed line for the substance to be dispersed, the fluid is prevented by centrifugal forces from flowing into the feed line for the substance to be dispersed.

Alternatively, the supply of the substance to be dispersed can also take place gravimetrically. In this case, the feed line for the substance to be dispersed is positioned vertical or at an angle less than or equal to 70° to the vertical.

The invention also relates to a method for dispersing at least one substance in a fluid, in particular in a liquid, by means of a device comprising a process housing with a rotor, a fluid supply, a feed line for the at least one substance to be dispersed having an outlet opening, as well as a product outlet. The rotor brings about an axial delivery of a supplied fluid at least in some sections. Furthermore, the rotor brings about a radial delivery of the supplied fluid at least in some sections.

As an alternative or in addition to the described features, the method can comprise one or more features and/or properties of the device described above.

The device and the method are suitable for dispersing a substance in a fluid, in particular in a liquid. In particular, it is possible with the device according to the invention and/or the method according to the invention to wet and/or disperse a powdery solid for the most part without the aid of mechanical forces such as are generated for example by a conventional rotor-stator system or by the use of grinding bodies. Instead of mechanical forces, use is made of physical effects in the device or with the method, for example pressure differences and the associated expansion and compression of air contained in the powder.

The device is more compact than traditionally known devices. Since the device is designed technically simpler than known devices, it can be produced more cost-effectively. The technically simplified design facilitates the cleaning and maintenance of the device. The simplified cleaning renders the device particularly interesting for smaller and medium-sized product batches and more frequent product changes.

The device employs a conventional rotor-stator principle for the dispersion of the substance to be dispersed in a fluid. This means in particular that the product does not have to be pumped by a stator. A lower shear on the product advantageously occurs. Furthermore, the device and the method are characterised by a lower energy input, as a result of which the temperature increase is also less than in the case of traditionally known devices. Furthermore, the device is less susceptible to failure and/or less susceptible to wear. In particular, the device is less sensitive in the case of foreign bodies contained in the powdery substance to be dispersed or in the fluid.

BRIEF DESCRIPTION OF THE DRAWINGS

Examples of embodiment are intended to explain the invention and its advantages in greater detail below with the aid of the appended figures. The size ratios of the individual elements with respect to one another in the figures do not always correspond to the actual size ratios, since some forms are represented simplified and other forms are represented enlarged in relation to other elements for the sake of better illustration.

DETAILED DESCRIPTION

Identical reference numbers are used for identical or identically acting elements of the invention. Furthermore, for the sake of clarity, only reference numbers that are required for the description of the given figure are represented in the individual figures. The represented embodiments only represent examples as to how the device according to the invention or the method according to the invention can be constituted and do not represent a conclusive limitation.

Figure 1:
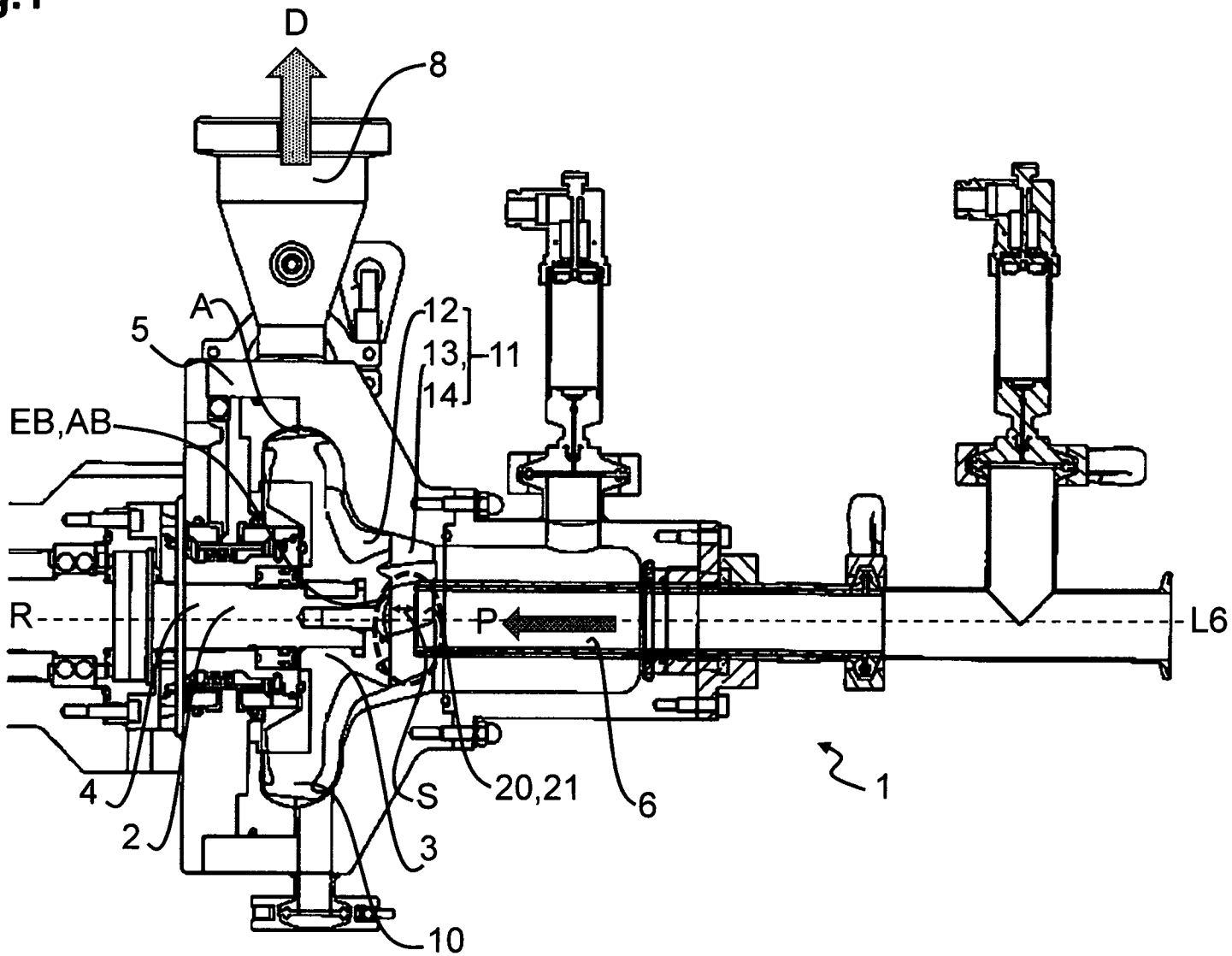
FIG. 1 shows a diagrammatic cross-section of a dispersion device according to the invention.
Figure 2:
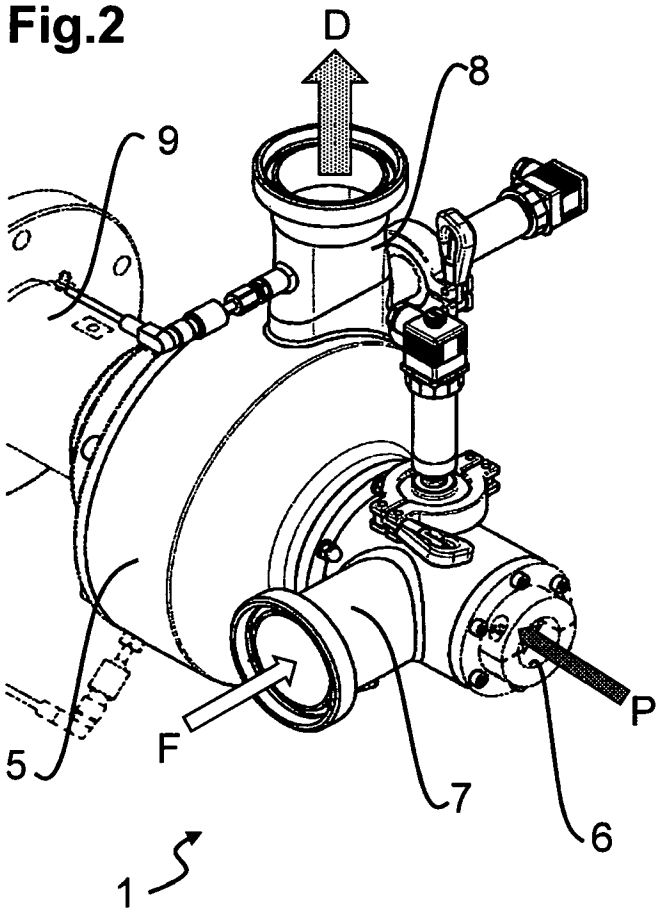
FIG. 2 shows a perspective representation of a dispersion device according to the invention.

FIG. 1 shows a diagrammatic cross-section of a dispersion device 1 according to the invention and FIG. 2 shows a perspective representation of a dispersion device 1 according to the invention. Dispersion device 1 is used in particular to disperse a powdery substance P in a fluid F, in particular a liquid, and thus to produce a dispersion D. Dispersion device 1 comprises a drive motor (not represented), a bearing 9, in which drive shaft 2 is mounted, and a coupling lantern with an internal shaft coupling and a drive motor (not represented) for the power transmission from the motor shaft to drive shaft 2. Drive shaft 2 serves to drive rotor 3. Furthermore, dispersion device 1 comprises a rotating bearing of drive shaft 2, which is passed through a slip-ring seal 4 into process housing 5.

A rotor 3 and a product outlet 8 for discharging the product, in particular dispersion D, are arranged in process housing 5 in which the dispersion takes place. A feed line for powdery substance P to be dispersed, in particular a powder supply 6 for supplying powder P, and also a fluid supply 7 for supplying fluid F, is assigned to process housing 5 (see FIG. 2).

Figure 5:
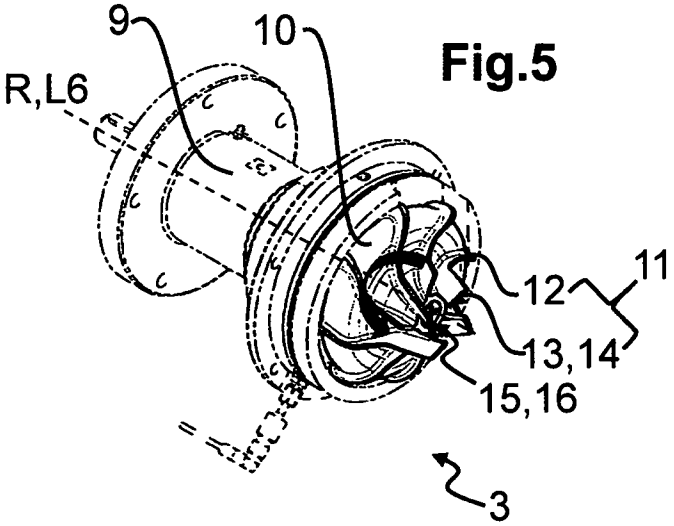
FIG. 5 shows a perspective representation of a rotor with a bearing.
Figure 6:
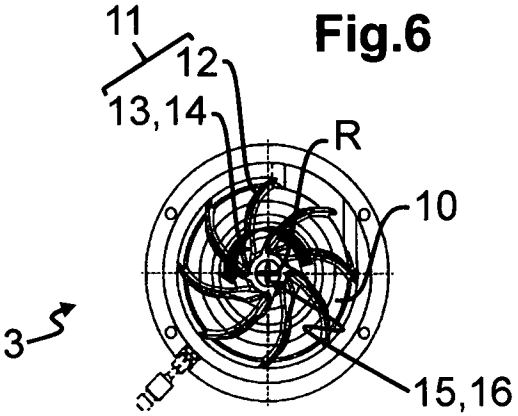
FIG. 6 shows a plan view of a rotor with a bearing.
Figure 4:
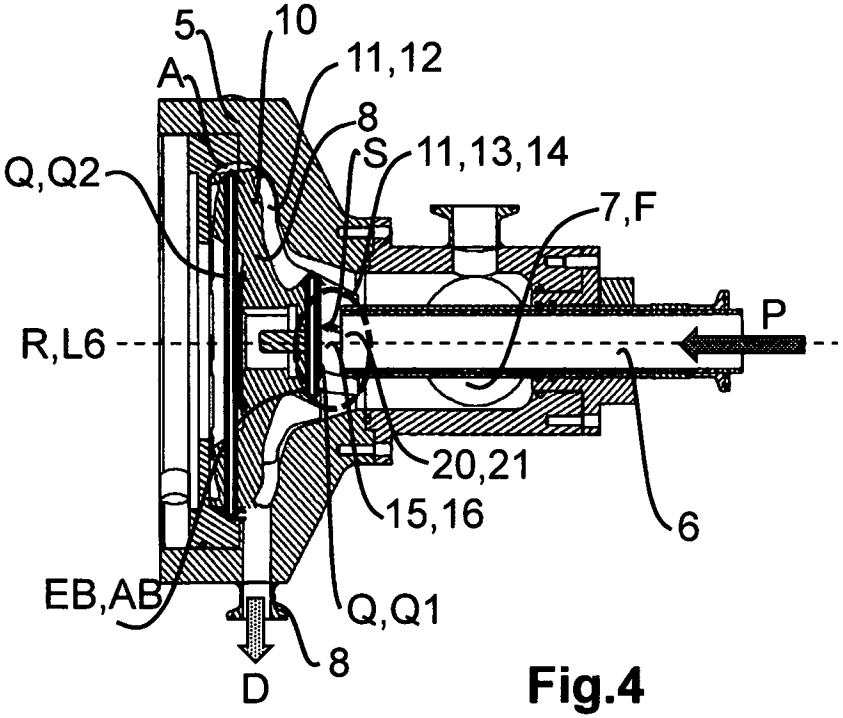
FIG. 4 shows a diagrammatic cross-sectional representation of a further embodiment of a process housing in a lateral representation.
Figure 3:
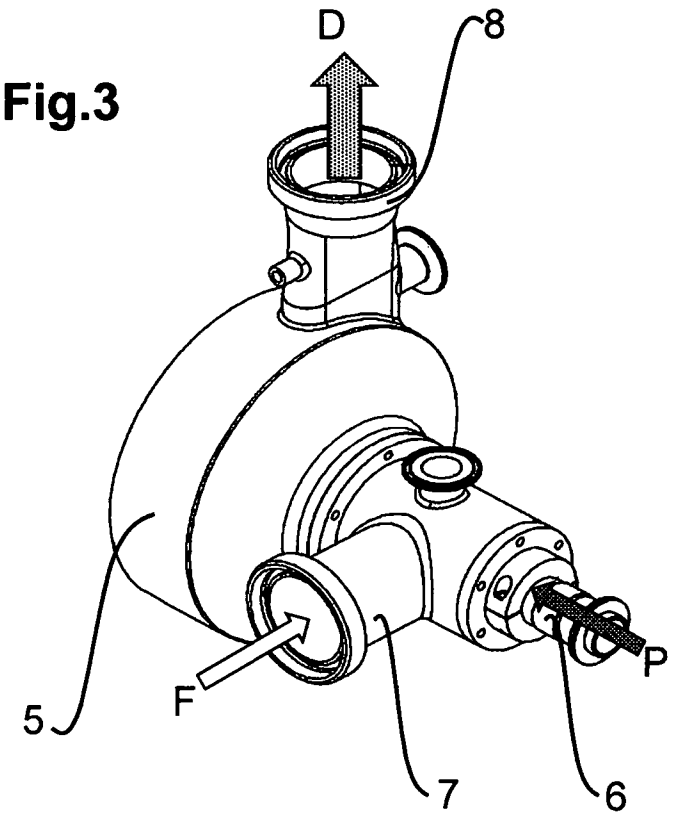
FIG. 3 shows a perspective representation of a process housing of a dispersion device.

FIG. 3 shows a perspective representation and FIG. 4 shows a diagrammatic cross-sectional representation of a process housing 5 with powder supply 6, fluid supply 7 and product outlet 8. FIGS. 5 and 6 show different representations of an embodiment of rotor 3.

Rotor 3 is rotatable about a rotational axis R and comprises a solid rotor core 10. Rotor 3 has a cross-sectional area Q, which increases towards the drive side at least in some sections. In other words, cross-sectional area Q of rotor 3 diminishes in the direction of powder supply 6. In particular, rotor 3 comprises, in a region adjacent to powder supply 6, a first cross-sectional area Q1, which is smaller than a second cross-sectional area Q2 in a region of rotor 3 close to the drive (see in particular FIG. 4).

Guide structures 11, which bring about a directed guidance of fluid F and respectively powder P, are arranged on rotor core 10. Each guide structure 11 essentially comprises two partial regions 12, 13, wherein first partial region 12 is arranged on and fastened to solid rotor core 10 and wherein second partial region 13 represents an axial extension 14 of guide structure 11 beyond solid rotor core 10. In particular, guide structures 11 are inclined in the axial direction in the region of extension 14, in order that they convey in particular axially. In contrast, guide structures 11 in first partial region 12 are additionally curved backwards in order to achieve a high outlet pressure and a good delivery effect.

Extensions 14 of the guide structures 11 are recessed in the region of rotational axis R of rotor 3 and form an axial opening 15. This opening 15 serves in particular as an accommodation 16 for an end region 20 of powder supply 6 (see FIGS. 1 and 4). In particular, the at least one powder outlet opening 21 of powder supply 6 is surrounded by guide structures 11 of rotor 3 inside accommodation 16 (see FIGS. 1 and 4). When rotor 3 rotates about rotational axis R, centrifugal forces arise, which have the effect of conveying fluid F outwards and thus of keeping it away from powder outlet opening 21. A penetration of fluid F into powder supply 6 can thus be effectively prevented.

In particular, insertion region EB (see FIGS. 1 and 4), in which powder supply 6 is inserted into rotor 3 at least in some sections, corresponds in particular to insertion region EB, in which powder supply 6 is inserted into extensions 14 of the guide structures of rotor 3, and therefore also to outlet region AB, in which powder P exits from the at least one powder outlet opening 21 of powder supply 6 and passes in particular into fluid F.

Rotor 3 is preferably formed such that, already in the region around end region 20 of powder supply 6, an axial delivery effect of fluid F in the direction of solid rotor core 10 or in the direction of product outlet 8 is achieved. This axial delivery transforms with an increasing diameter of rotor 3, i.e. with increasing cross-sectional area Q of rotor 3 in the direction of product outlet 8, into a radial delivery effect, up to a region in which fluid F is now delivered solely radially. In addition to the axial and radial delivery effect, fluid F is caused to rotate due to the rotation of rotor 3 about rotational axis R.

Powder supply 6 can be closed in end region 20 and can comprise lateral openings as powder outlet openings 21, via which an exit of the powder from powder supply 6 preferably takes place in the radial direction.

Provision can be made such that powder supply 6 can be displaced axially along a longitudinal axis L6. Longitudinal axis L6 can preferably be aligned coaxial or parallel with rotational axis R of rotor 2. In particular, the depth to which end region 20 of powder supply 6 is inserted into extensions 14 of guide structures 11 can be adjusted by the axial displacement of powder supply 6. A spacing is constituted in the radial direction between extensions 14 of guide structures 11 and powder supply 6. This spacing ensures in particular an undisrupted rotation of rotor 3 about powder supply 6 and also enables the unhindered exit of powder P from the at least one powder outlet opening 21. The radial spacing between extensions 14 of guide structures 11 and powder supply 6 preferably amounts to between 0.1 mm and 10 mm. It is clear to the person skilled in the art that the spacing is matched in particular to the size of the overall device and/or to the substances and/or products to be processed.

Furthermore, a gap S in the axial direction is present between powder supply 6 and solid rotor core 10, through which gap powder P supplied via powder supply 6 passes radially into fluid F.

A spacing A between rotor 3 and process housing 5 (see FIGS. 1 and 4) amounts to between 0.1 mm and 10 mm. The smaller the spacing A, the higher the shearing forces acting inside fluid F, which can promote the dispersing action.

Powder supply 6 can have an enlarged outer diameter in end region 20, in particular in the region of the at least one powder outlet opening 21. The increased diameter serves as an additional deflecting element, which additionally prevents a penetration of fluid F into the region of powder outlet opening 21.

The supply of fluid F, of powder P or of product suspension or dispersion D takes place via relatively large pipe cross-sections of powder supply 6 and fluid supply 7. Flow resistances in particular are thus kept small and products up to average viscosities can also be processed without a pump. If for example a product is conveyed in a circuit in order to add powder P gradually until the desired final concentration is reached, the addition of the product already containing powder then usually takes place via the feed line of fluid supply 7.

In order to be able to process products with different viscosities in the optimum manner in each case, a valve or suchlike can be incorporated at the product inlet of fluid supply 7 in order to slow down the through-flow for products with low viscosities (not represented).

In the case of dispersion device 1 according to the invention, the supply of fluid F can take place with or without a pump depending on the given fluid F or circulating dispersion product D.

Fluid F enters in the product inlet of fluid supply 7 into process housing 5, is taken up by rotating rotor 3 and accelerated in the axial and radial direction. A pumping effect thus occurs, which pumps fluid F through product outlet 8 back into a container (not represented). An underpressure thus arises in process housing 5. As soon as powder supply 6, usually regulated by a valve (not represented), is opened, a suction effect occurs on account of the underpressure in process housing 5. Powder P is sucked in the direction of rotor 3. Powder P exits out of powder supply 6 via the at least one powder outlet opening 21 and passes radially into fluid F. Dispersion D thus arising is removed from process housing 5 via product outlet 8 by means of rotor 3. As a result of the narrow gap between guide structures 11 and powder supply 6, the fluid is prevented by centrifugal forces from flowing into powder supply 6.

The valves on fluid supply 7 and on powder supply 6 are intended in particular either to completely open or completely close the supply, in order to prevent flooding of dispersion device 1.

Dispersion device 1 according to the invention can be used without additional machines. Only a product or batching container (not represented) or a suitable powder feeding system (not represented) is required. Conventionally known systems are suitable as a powder feeding system, for example a suction lance, a bag feeding station, a BigBag feeding station, a silo or suchlike. By means of dispersion device 1, powder P can be sucked into and finely dispersed in fluids F, in particular in liquids.

Figure 8:
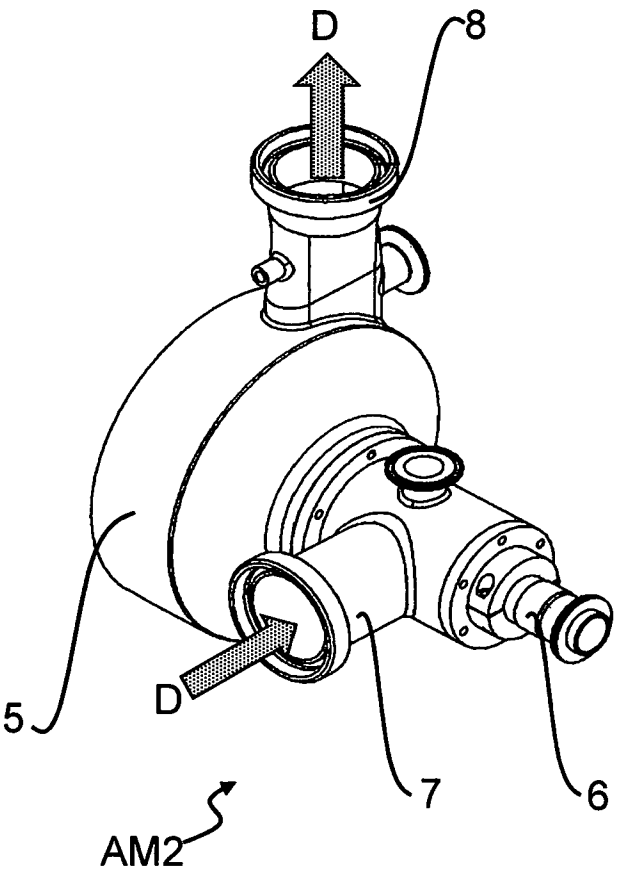
FIG. 8 represents a second operating mode.
Figure 7:
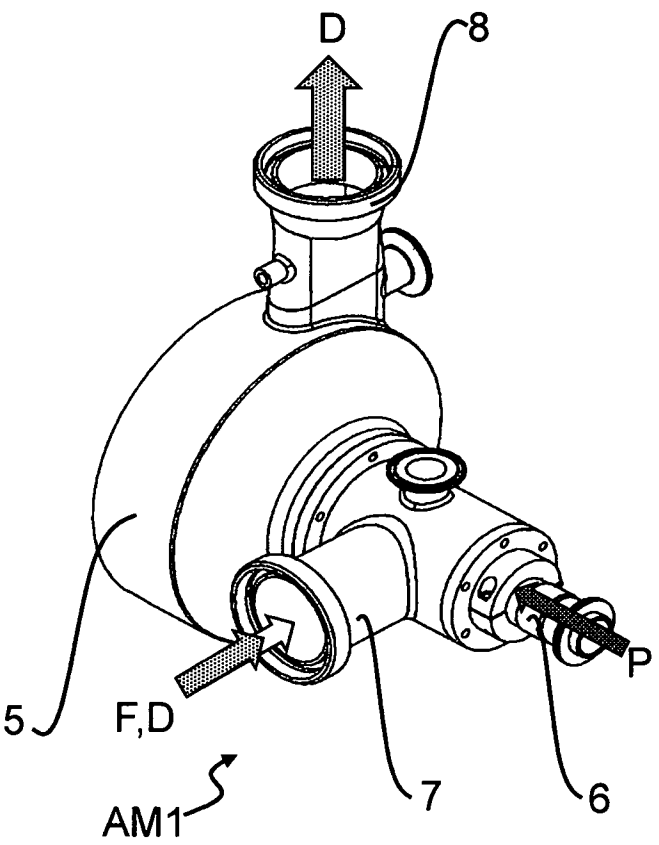
FIG. 7 represents a first operating mode.

FIG. 7 represents a first operating mode AM1 and FIG. 8 represents a second operating mode AM2. In first operating mode AM1 according to FIG. 7, powder supply 6 is opened. In particular, a valve (not represented) regulating powder supply 6 is opened. In this first operating mode AM1, fluid F or dispersion product D comprising powder P dispersed in fluid F circulates between a product or batching container and dispersion device 1 (in FIGS. 7 and 8, only process housing 5 with supply and discharge lines 6, 7, 8 is represented in each case), wherein powder P is continuously supplied, in particular sucked in, via powder supply 6. The powder feed can take place for example by means of a funnel, a BigBag station, a silo, a suction lance or suchlike.

In a second operating mode AM2 according to FIG. 8, powder supply 6 is closed by means of a valve (not represented). Instead, dispersion product D continuously circulates between the product or batching container and process housing 5 of dispersion device 1. A strong underpressure arises in process housing 5, which leads to (micro-)cavitation inside dispersion D. Furthermore, dispersion product D, i.e. powder P dispersed in fluid F, is subjected to a shearing effect between guide structures 11 and process housing 5 (see FIGS. 1 and 4). In order to achieve a higher pressure and a longer dwell time of dispersion product D or powder P dispersed in fluid F in process housing 5, a further valve (not represented) can be arranged at product outlet 8, or the product flow is slowed down with a suitable pipeline. These measures or effects have a favourable effect on the dispersion quality.

Figure 9:
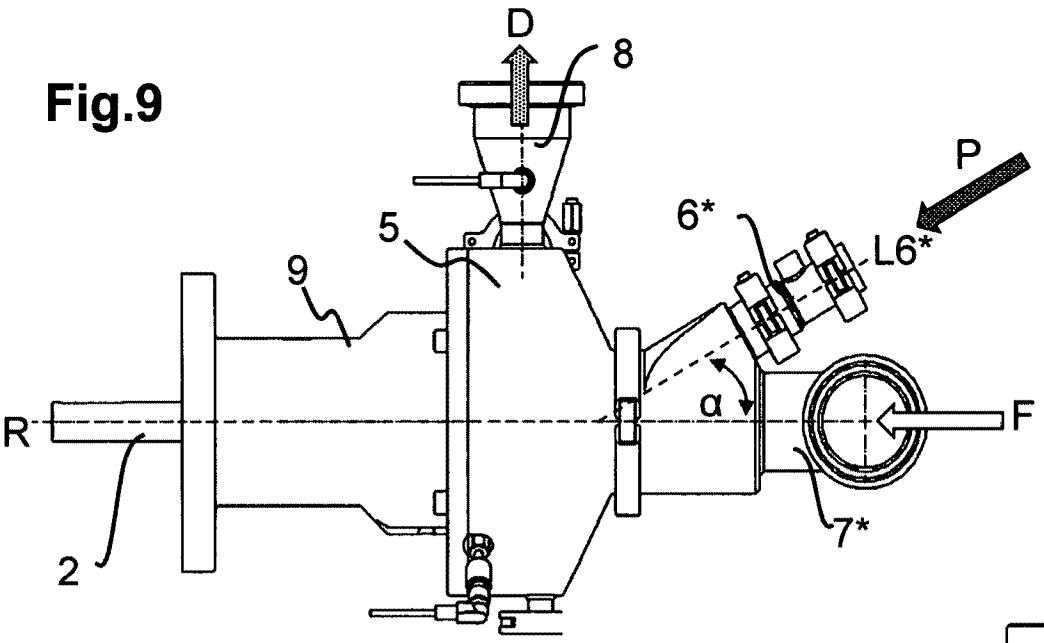
FIG. 9 shows a lateral representation of a further embodiment of a dispersion device according to the invention.
Figure 10:
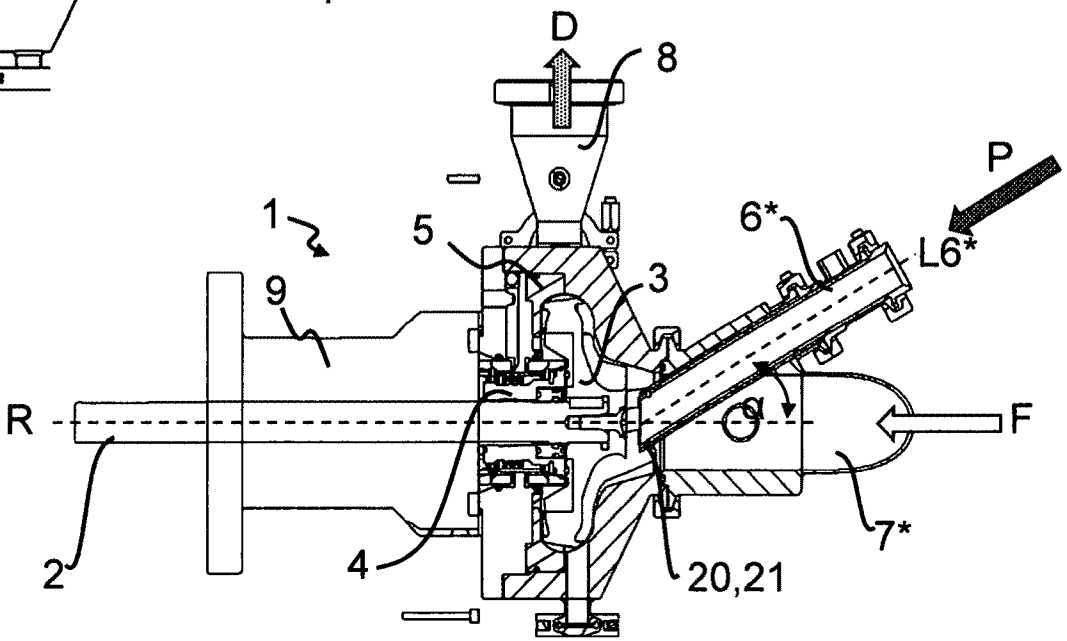
FIG. 10 shows a cross-sectional representation through a lateral representation of an embodiment of an inventive dispersion device according to FIG. 9.
Figure 12:
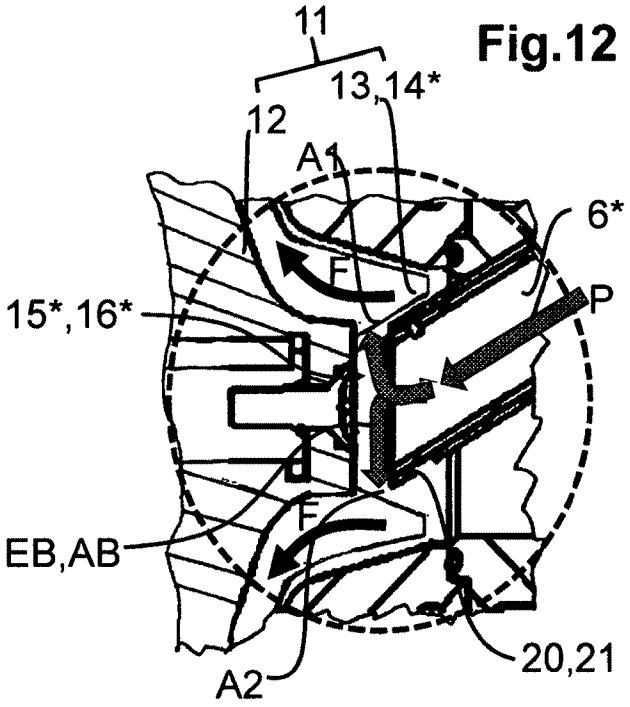
FIG. 12 shows a detail from FIG. 11.
Figure 11:
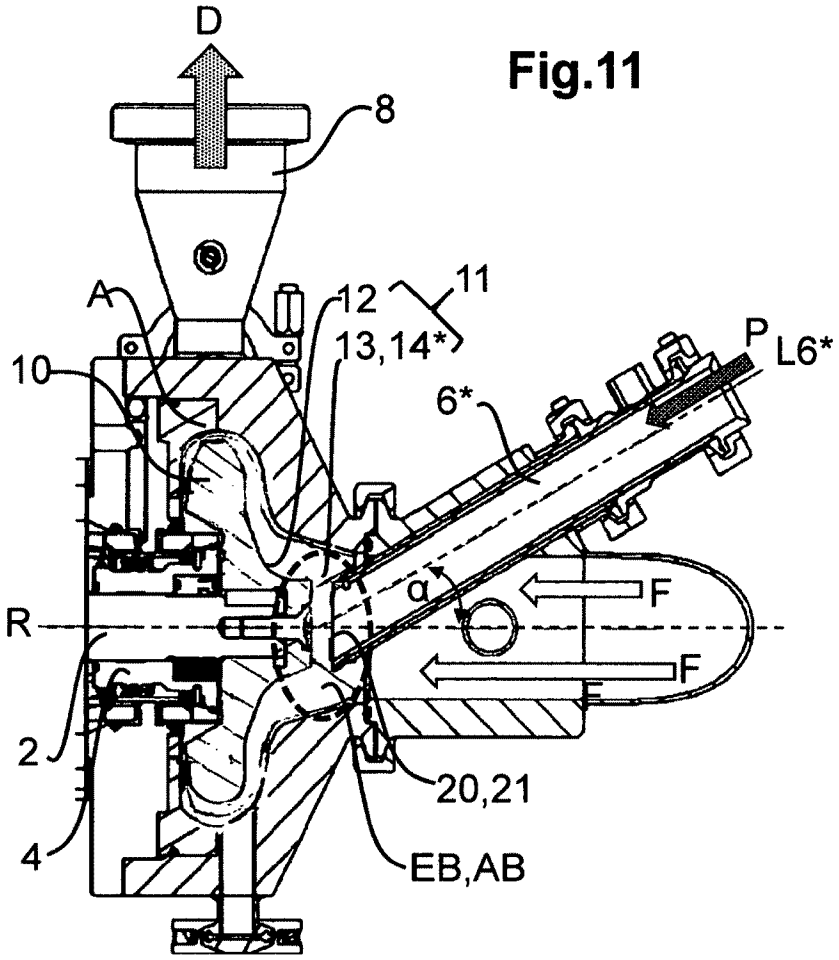
FIG. 11 shows a diagrammatic cross-sectional representation of the process housing of the embodiment according to FIG. 9.
Figure 13:
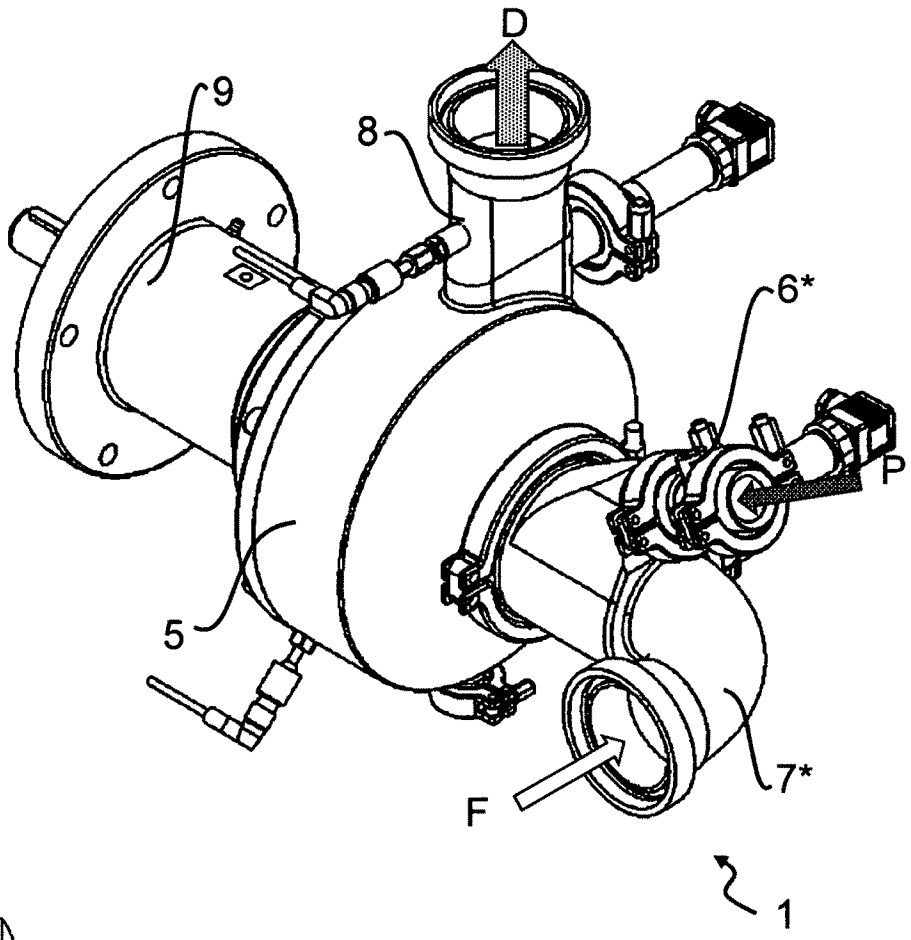
FIG. 13 shows a perspective representation of the process housing of the dispersion device according to FIG. 9.
Figure 14:
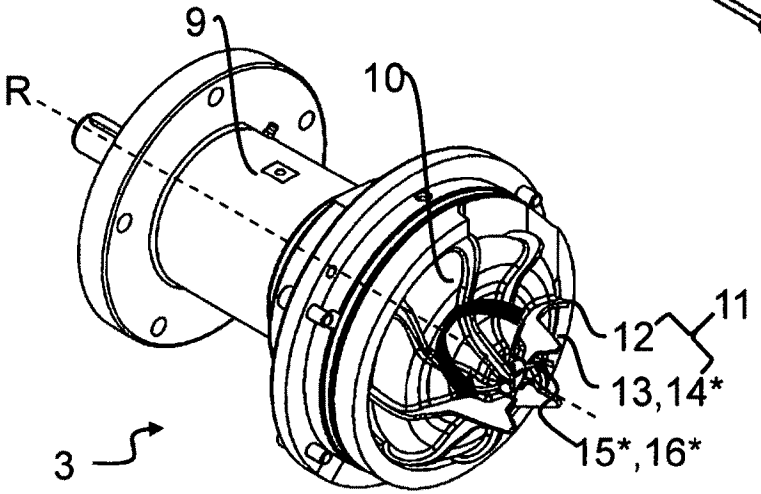
FIG. 14 shows a perspective representation of a rotor with a bearing of the embodiment according to FIG. 9.

FIG. 9 shows a lateral representation of a further embodiment of a dispersion device 1 according to the invention. FIG. 10 shows a cross-sectional representation through dispersion device 1 according to FIG. 9. FIG. 11 shows a diagrammatic cross-sectional representation and FIG. 13 shows a perspective representation of the process housing of the embodiment according to FIG. 9. FIG. 12 represents a detail from FIG. 11 and FIG. 14 shows a perspective representation of a rotor with a bearing of the embodiment of dispersion device 1 according to FIG. 9. Identical components are provided with the same reference numbers as in FIGS. 1 to 8, to the description whereof reference is hereby made.

Dispersion device 1 comprises a drive motor (not represented), a bearing 9, in which drive shaft 2 is mounted, and a coupling lantern with an internal shaft coupling. Dispersion device 1 also comprises a drive motor (not represented) for the power transmission from the motor shaft to drive shaft 2, which is used to drive rotor 3. A rotating bearing of drive shaft 2 is also provided, which is passed through a slip-ring seal 4 into a process housing 5. A rotor 3 and a product outlet 8 for discharging the product, in particular dispersion D, are arranged in process housing 5, in which the dispersion of a powdery substance P into a fluid F takes place. A feed line for powdery substance P to be dispersed is also assigned to process housing 5, in particular a powder supply 6*, and also a fluid supply 7* for supplying fluid F.

In contrast with the embodiment represented in FIGS. 1 to 8, longitudinal axis L6* of powder supply 6* is arranged at an angle $\alpha$ to rotational axis R of rotor 3 in the embodiment represented in FIGS. 9 to 14. In particular, powdery substance P is thus fed to rotor 3 obliquely from top to bottom. Powder supply 6* ends in an analogous manner to powder supply 6 according to FIGS. 1 and 4 in the centre of rotor 3, in particular end region 20 of powder supply 6* with powder outlet opening 21 being inserted between axial extensions 14* of guide structures 11 of rotor 3. Analogous to guide structures 11 described in detail in connection with FIGS. 5 and 6, extensions 14* of guide structures 11 are also recessed in the region of rotational axis R of rotor 3 and form an axial opening 15*. This opening 15* serves in particular as an accommodation 16* for an end region 20 of powder supply 6* (see in particular FIGS. 12 and 14). In particular, the at least one powder outlet opening 21 of powder supply 6* is surrounded inside accommodation 16* by extensions 14* of guide structures 11 of rotor 3 (see FIGS. 10 to 12). When rotor 3 rotates about rotational axis R, centrifugal forces arise, the effect whereof is that fluid F is conveyed outwards and thus kept away from powder outlet opening 21. A penetration of fluid F into powder supply 6* can thus be effectively prevented.

In particular, insertion region EB, in which powder supply 6* is inserted into rotor 3 at least in some sections, corresponds in particular to insertion region EB, in which powder supply 6* is inserted into extensions 14* of guide structures 11 of rotor 3, and therefore also to outlet region AB, in which powder P exits from the at least one powder outlet opening 21 of powder supply 6* and passes in particular into fluid F.

Likewise in this embodiment, powdery substance P is thus fed in the centre of rotor 3, as can clearly be seen particularly in the enlarged detail representation of FIG. 12. Rotor blades or guide structures 11 surround end region 20 of powder supply 6* and thus effectively prevent fluid F from getting into powder supply 6*. Fluid F is centrifuged outwards by guide structures 11, in particular by first partial region 12 of guide structures 11. The special embodiment of powder supply 6* inserted into rotor blades or guide structures 11 thus forms a dynamic barrier between powdery substance P and fluid F.

End region 20 of powder supply 6* can be cut away in insertion region EB, in which it is inserted into rotor 3, in such a way that end region 20 forms a face perpendicular to rotational axis R of rotor 3. Alternatively, end region 20 can be cut away at an arbitrary angle with respect to longitudinal axis L6* of powder supply 6*.

Angle $\alpha$, at which powder supply 6* is arranged with respect to rotational axis R of rotor 3, can amount to between 0° up to 90°. The spacing of powder supply 6* from rotor 3 can amount arbitrarily to between 0.5 mm and 100 mm. The overlap of the rotor blades or the overlap of extensions 14* of guide structures 11 over powder supply 6*, in particular the surrounding of powder supply 6* by extensions 14* of guide structures 11, can amount preferably to between 1 mm and 100 mm.

Due to the angular entry of powder supply 6* into axial opening 15* or accommodation 16* between axial extensions 14* of guide structures 11, the recess between extensions 14*, which form opening 15* or accommodation 16*, is constituted opened in order to enable unhindered rotation of rotor 3 (see FIG. 12). A first spacing A1 between powder supply 6* and extensions 14* thus arises in the lower region and a second spacing A2 between powder supply 6* and extensions 14* thus arises in the upper region. First spacing A1 is greater than second spacing A2. Larger first spacing A1 in the lower region is however unproblematic, since no fluid F flows from below into powder supply 6*.

Particularly when dispersion device 1 is at a standstill, this embodiment has proved to be advantageous if residual fluid still happens to the present in the latter. In the embodiment according to FIGS. 1 to 7, a flow of residual fluid into powder supply 6 can occur in exceptional cases in the rest state, which can then lead to sticking of powdery substance P inside powder supply 6.

In an embodiment with an inlet geometry of powder supply 6* between extensions 14* of guide structures 11 of rotor 3, as represented and described according to FIGS. 9 to 14, this residue risk is completely eliminated. Even when dispersion device 1 is in the state when switched off, an undesired flow of fluid F into powder supply 6* does not occur with this embodiment.

The invention has been described by reference to a preferred embodiment. A person skilled in the art can however imagine that modifications or changes to the invention can be made without thereby departing from the scope of protection of the following claims.

The invention claimed is:

1. A device for dispersing at least one substance in a fluid comprising: a process housing with a rotor, a fluid supply, a feed line for the at least one substance to be dispersed having at least an outlet opening, as well as a product outlet, an insertion region in which the at least one substance exits the outlet opening into a supplied fluid at the rotor, wherein an axial delivery of the supplied fluid can be generated by the rotor at least in some sections and wherein a radial delivery of the supplied fluid can be generated by the rotor at least in some sections, the supplied fluid and the substance to be dispersed flow in a flow path toward the rotor, and the supplied fluid enters the flow path upstream from both the rotor and the outlet opening, wherein the feedline is surrounded at least in some sections by the rotor.

2. The device according to claim 1, wherein the rotor includes at least one first region for generating the axial delivery at least in some sections and wherein the rotor includes at least one second region for generating the radial delivery at least in some sections.

3. The device according to claim 1, wherein the feed line for the substance to be dispersed is surrounded at least in some sections by the rotor and wherein the at least one outlet opening is arranged in a region of the rotor in which the fluid can be delivered axially.

4. The device according to claim 1, wherein the rotor includes guide structures for generating an axial delivery effect and wherein a radial delivery effect can be generated by a widening of a rotor cross-section and/or by a rotation of the rotor.

5. The device according to claim 4, wherein the guide structures are constituted on the side of the rotor facing the feed line for the substance to be dispersed and wherein at least one of the guide structures is extended beyond a solid core of the rotor axially in the direction of the feed line for the substance to be dispersed, wherein the at least one outlet opening of the feed line for the substance to be dispersed is surrounded by the at least one extended guide structure at least in some sections.

6. The device according to claim 5, wherein the number of the extended guide structures is variable in relation to the number of the total guide structures.

7. The device according to claim 5, wherein the feed line for the substance to be dispersed has a first longitudinal axis and wherein the rotor is mounted rotatably about a rotational axis, wherein the longitudinal axis of the feed line for the substance to be dispersed and the rotational axis of the rotor are aligned coaxial or parallel and wherein an outlet opening of the feed line for the substance to be dispersed is arranged aligned with the longitudinal axis of the feed line for the substance to be dispersed and the rotational axis of the rotor or wherein the longitudinal axis of the feed line for the substance to be dispersed and the rotational axis of the rotor are arranged at a defined angle with respect to one another.

8. The device according to claim 1, wherein the fluid supply is arranged largely orthogonal to the feed line for the substance to be dispersed or wherein the fluid supply is arranged at an angle between 0 degrees and 90 degrees with respect to the feed line for the for the substance to be dispersed.

9. The device according to claim 7, wherein the fluid supply has a second longitudinal axis, which is arranged orthogonal or at an angle to the first longitudinal axis of the feed line for the substance to be dispersed and wherein the fluid supply is arranged spaced apart from the rotor, so that introduced fluid flows at least in some sections around the feed line for the substance to be dispersed.

10. The device according to claim 9, wherein the fluid can be conveyed outwards from the middle of the rotor by the guide structures of the rotor and the centrifugal forces occurring during the rotation of the rotor.

11. The device according to claim 1, wherein the feed line for the substance to be dispersed can be adjustably displaced parallel to the rotational axis of the rotor.

12. The device according to claim 5, wherein the insertion depth of an end region of the feed line for the substance to be dispersed can be adjusted in relation to the extended guide structures of the rotor.

13. The device according to claim 5, wherein between the extended guide structures of the rotor and the feed line for the substance to be dispersed there is a radial spacing between 0.1 mm and 10 mm.

14. The device according to claim 2, wherein the feed line for the substance to be dispersed is surrounded at least in some sections by the rotor and wherein the at least one outlet opening is arranged in a region of the rotor in which the fluid can be delivered axially.

15. The device according to claim 6, wherein the feed line for the substance to be dispersed has a first longitudinal axis and wherein the rotor is mounted rotatably about a rotational axis, wherein the longitudinal axis of the feed line for the substance to be dispersed and the rotational axis of the rotor are aligned coaxial or parallel and wherein an outlet opening of the feed line for the substance to be dispersed is arranged aligned with the longitudinal axis of the feed line for the substance to be dispersed and the rotational axis of the rotor or wherein the longitudinal axis of the feed line for the substance to be dispersed and the rotational axis of the rotor are arranged at a defined angle with respect to one another.

16. The device according to claim 8, wherein the fluid supply has a second longitudinal axis, which is arranged orthogonal or at an angle to the first longitudinal axis of the feed line for the substance to be dispersed and wherein the fluid supply is arranged spaced apart from the rotor, so that introduced fluid flows at least in some sections around the feed line for the substance to be dispersed.

17. The device according to claim 1, wherein a longitudinal axis of the fluid supply is arranged substantially perpendicular to a longitudinal axis of the feed line.

18. The device according to claim 1, wherein the supplied fluid flows around at least a portion of the feed line for the substance to be dispersed.

19. A method for dispersing at least one substance in a supplied fluid, comprising:

providing the device according to claim 1;

delivering the supplied fluid axially at least in some sections of the rotor;

delivering the supplied fluid radially at least in some sections of the rotor.

20. A method for dispersing at least one substance in a fluid by a device including: a process housing with rotor, a fluid supply, a feed line for the at least one substance to be dispersed having at least an outlet opening, as well as a product outlet, an insertion region in which the at least one substance exits the outlet opening into a supplied fluid at the rotor, the rotor bringing about an axial delivery of the supplied fluid at least in some sections and the rotor bringing about a radial delivery of the supplied fluid at least in some sections, wherein the supplied fluid and the at least one substance flow in a flow path toward the rotor, and the supplied fluid enters the flow path upstream from both the rotor and the outlet opening, wherein the feedline is surrounded at least in some sections by the rotor.

* * * * *